US010675777B2

(12) United States Patent
Higuchi

(10) Patent No.: US 10,675,777 B2
(45) Date of Patent: Jun. 9, 2020

(54) SHEET MANUFACTURING APPARATUS, AND SHEET MANUFACTURING METHOD

(71) Applicant: SEIKO EPSON CORPORATION, Tokyo (JP)

(72) Inventor: Naotaka Higuchi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 155 days.

(21) Appl. No.: 15/758,395

(22) PCT Filed: Sep. 5, 2016

(86) PCT No.: PCT/JP2016/004045

§ 371 (c)(1),
(2) Date: Mar. 8, 2018

(87) PCT Pub. No.: WO2017/043066

PCT Pub. Date: Mar. 16, 2017

(65) Prior Publication Data

US 2018/0257258 A1 Sep. 13, 2018

(30) Foreign Application Priority Data

Sep. 11, 2015 (JP) ..... 2015-179274

(51) Int. Cl.
*B27N 3/04* (2006.01)
*D01G 9/10* (2006.01)
(Continued)

(52) U.S. Cl.
CPC ..... *B27N 3/04* (2013.01); *B27N 3/146* (2013.01); *D01G 9/10* (2013.01); *D04H 1/732* (2013.01); *D21B 1/06* (2013.01); *D21F 9/00* (2013.01)

(58) Field of Classification Search
CPC . B27N 3/04; B27N 3/146; B27N 3/00; B27N 3/007; B27N 3/02; B27N 3/06;
(Continued)

(56) References Cited

U.S. PATENT DOCUMENTS 2,222,633 A * 11/1940 Sheesley ..... D21B 1/00 425/82.1
2,451,915 A * 10/1948 Buresh ..... D04H 1/72 19/89
(Continued)

FOREIGN PATENT DOCUMENTS

CN 104863003 A 8/2015
JP 2012-144819 A 8/2012
(Continued)

OTHER PUBLICATIONS

Ke Qinfei et al., "NONWOVENS", pp. 67-70, Donghua University Press, Sep. 2004, 1st edition.

*Primary Examiner* — Ismael Izaguirre
(74) *Attorney, Agent, or Firm* — Global IP Counselors, LLP

(57) ABSTRACT

A sheet manufacturing apparatus suppresses material being left in a material supply conduit while manufacturing sheets with uniform grammage. A sheet manufacturing apparatus includes: a rotatable, foraminous drum unit; a web forming unit configured to form a web using material including fiber that has passed through the holes in the drum unit; and a material supply conduit having a connector that connects to the drum unit, and carrying material including fiber into the drum unit by air flow; the velocity of the flow in the connector being lower than the velocity of the flow on the upstream side of the connector.

15 Claims, 6 Drawing Sheets

(51) Int. Cl.

| | |
|---|---|
| ***D21B 1/06*** | (2006.01) |
| ***D21F 9/00*** | (2006.01) |
| ***D04H 1/732*** | (2012.01) |
| ***B27N 3/14*** | (2006.01) |

(58) Field of Classification Search
CPC ... B27N 3/08; D01G 9/10; D01G 9/00; D01G 9/06; D01G 9/08; D01G 9/12; D01G 9/14; D01G 9/16; D01G 9/18; D04H 1/732; D04H 1/736; D04H 1/70–76; D21B 1/06; D21F 9/00
See application file for complete search history.

(56) References Cited

U.S. PATENT DOCUMENTS

| | | | | | |
|---|---|---|---|---|---|
| 2,646,381 | A | | 7/1953 | Duvall | |
| 2,718,671 | A | * | 9/1955 | Smith | D01G 9/06 19/200 |
| 2,746,096 | A | * | 5/1956 | Baxter | B27N 3/14 425/80.1 |
| 3,051,998 | A | * | 9/1962 | Rust, Jr. | D04H 1/72 19/307 |
| 3,481,005 | A | * | 12/1969 | Owens | D04H 1/72 19/306 |
| 3,680,175 | A | * | 8/1972 | Kamp | D04H 1/72 425/83.1 |
| 3,961,397 | A | * | 6/1976 | Neuenschwander | D01G 5/00 19/65 R |
| 4,051,576 | A | * | 10/1977 | Baburin | D04H 1/732 425/83.1 |
| 4,640,810 | A | * | 2/1987 | Laursen | D04H 1/732 264/121 |
| 4,761,858 | A | * | 8/1988 | Maijala | D21H 27/00 19/296 |
| 8,882,965 | B2 | * | 11/2014 | Yamagami | D21B 1/08 162/261 |
| 9,309,622 | B2 | | 4/2016 | Higuchi | |
| 2014/0027075 | A1 | | 1/2014 | Yamagami et al. | |
| 2015/0184341 | A1 | | 7/2015 | Tanaka | |
| 2015/0240417 | A1 | | 8/2015 | Higuchi | |
| 2016/0145801 | A1 | | 5/2016 | Fujita et al. | |
| 2016/0145802 | A1 | | 5/2016 | Higuchi | |
| 2016/0145803 | A1 | | 5/2016 | Higuchi | |

FOREIGN PATENT DOCUMENTS

| | | | | |
|---|---|---|---|---|
| JP | 2015-123701 | A | | 7/2015 |
| JP | 2016-098470 | A | | 5/2016 |
| JP | 2016-098473 | A | | 5/2016 |
| WO | WO 2015097944 | A1 | * | 7/2015 |

* cited by examiner

SHEET MANUFACTURING APPARATUS, AND SHEET MANUFACTURING METHOD

CROSS-REFERENCE TO RELATED APPLICATIONS

This application is a U.S. National stage application of International Patent Application No. PCT/JP2016/004045, filed on Sep. 5, 2016, which claims priority under 35 U.S.C. § 119(a) to Japanese Patent Application No. 2015-179274, filed in Japan on Sep. 11, 2015. The entire disclosure of Japanese Patent Application No. 2015-179274 is hereby incorporated herein by reference.

TECHNICAL FIELD

The present invention relates to a sheet manufacturing apparatus, and a sheet manufacturing method.

BACKGROUND

Sheet manufacturing apparatuses conventionally use a slurry process in which feedstock including fiber is soaked in water, defibrated by primarily a mechanical action, and then rescreened. Sheet manufacturing apparatuses using such wet slurry methods require a large amount of water, and are large. Maintenance of the water processing system is also laborious, and the drying process requires much energy.

Dry process sheet manufacturing apparatuses that use little to no water have therefore been proposed to reduce equipment size and energy consumption. For example, JP-A-2012-144819 describes defibrating pieces of paper into fibers in a dry-process defibrator, deinking the fibers in a cyclone separator, passing the deinked fiber through a foraminous screen on the surface of a forming drum, and laying the fiber on a mesh belt using the suction of a suction device to form paper. The technology described in JP-A-2012-144819 strengthens the hydrogen bonds between fibers by misting the sheet of deinked fiber laid on the mesh belt with water by means of a water sprayer.

SUMMARY

In a sheet manufacturing apparatus such as described above, material including fiber is supplied (conveyed) to the drum unit by an air flow produced inside a material supply conduit, but if the velocity of the air flow is low, material may accumulate inside the material supply conduit. Furthermore, if the velocity of the air flow is too great, the force pushing the material horizontally inside the drum increases, and the uniformity of the grammage of the manufactured sheet may deteriorate.

One object of the several embodiments of the invention is to provide a sheet manufacturing apparatus capable of manufacturing sheets with uniform grammage while suppressing residue of material in the material supply conduit. Another object of the several embodiments of the invention is to provide a sheet manufacturing method enabling manufacturing sheets with uniform grammage while suppressing residue of material in the material supply conduit.

The invention is directed to solving at least part of the foregoing problem, and can be embodied by the embodiments and examples described below.

A first aspect of the invention of a sheet manufacturing apparatus according to the invention includes: a rotatable, foraminous drum unit; a web forming unit configured to form a web using material including fiber that has passed through the holes in the drum unit; and a material supply conduit having a connector that connects to the drum unit, and carrying material including fiber into the drum unit by air flow; the velocity of the flow in the connector being lower than the velocity of the flow on the upstream side of the connector.

A sheet manufacturing apparatus according to the invention can reduce the force pushing material including fiber horizontally inside the drum unit. As a result, the uniformity of the web thickness can be improved, and the uniformity of the grammage of the manufactured sheet can be improved. In addition, material including fiber being left inside the material containing fiber on the upstream side of the connector can be reduced in the sheet manufacturing apparatus. Therefore, in a sheet manufacturing apparatus thus comprised, sheets of uniform grammage can be manufactured while suppressing material accumulating inside the material supply conduit.

In a sheet manufacturing apparatus according to another aspect of the invention, wherein a first supply conduit of the material supply conduit splits at a junction into a second supply conduit and a third supply conduit; the second supply conduit and third supply conduit both connect to the drum unit; and the velocity of the air flow in the second supply conduit and third supply conduit is less than the velocity of the air flow in the first supply conduit.

In another aspect of the invention, both the second supply conduit and third supply conduit connect to the drum unit.

A sheet manufacturing apparatus thus comprised can supply material including fiber from both sides of the drum unit, and further improve the uniformity of the thickness of the web.

In a sheet manufacturing apparatus according to another aspect of the invention, the second supply conduit connects to the drum unit at one end of the axis of rotation; the third supply conduit connects to the drum unit at the other end of the axis of rotation; and the second supply conduit and third supply conduit are symmetrical to a virtual plane through the junction and perpendicular to the axis of rotation of the drum unit.

A sheet manufacturing apparatus thus comprised can reduce the difference between the amount of material per unit time supplied to the inside of the drum unit from the second supply conduit, and the amount of material per unit time supplied to the inside of the drum unit from the third supply conduit. As a result, the sheet manufacturing apparatus can further improve the uniformity of the thickness of the web.

In a sheet manufacturing apparatus according to another aspect of the invention, the junction is above the axis of rotation of the drum unit.

Because gravity can also be used to convey material to the drum unit, the sheet manufacturing apparatus thus comprised can manufacture sheets of uniform grammage while suppressing the amount of material that is left in the second supply conduit and third supply conduit (material supply conduit).

In a sheet manufacturing apparatus according to another aspect of the invention, the internal sectional area of the connector is greater than the internal sectional area of the material supply conduit on the upstream side of the connector.

Thus comprised, the sheet manufacturing apparatus can reduce the velocity of the air flow in the connector to less than the velocity of the air flow upstream from the connector.

In a sheet manufacturing apparatus according to another aspect of the invention, the material supply conduit has a transition wherein the internal sectional area increases gradually from the upstream side to the downstream side.

A sheet manufacturing apparatus thus comprised can suppress eddy currents, for example, resulting from disturbance of the air flow in the transition.

In a sheet manufacturing apparatus according to another aspect of the invention, the connector has a bend.

A sheet manufacturing apparatus thus comprised increases the degree of freedom in the shape of the material supply conduit, and shorten the conveyance length of the material supply conduit connecting the mixer and drum unit.

In a sheet manufacturing apparatus according to another aspect of the invention, the bend connects to the drum unit above the axis of rotation of the drum unit.

A sheet manufacturing apparatus thus comprised can reduce the likelihood of material being left on the inside side of the inside of the bend.

A sheet manufacturing apparatus according to another aspect of the invention also has a mixer configured to mix fiber and additive in air; the web forming unit laying a web using material including fiber and additive; and the mixer being located above the axis of rotation of the drum unit.

This sheet manufacturing apparatus can shorten the conveyance length of the material supply conduit connecting the mixer to the drum unit. In addition, because gravity can be used to convey material by connecting the material supply conduit to the drum unit at a position above the axis of rotation of the drum unit, sheets with good uniformity of grammage can be manufactured while suppressing material being left inside the material supply conduit.

A sheet manufacturing apparatus according to another aspect of the invention includes: a rotatable, foraminous drum unit; a web forming unit configured to form a web using material including fiber that has passed through the holes in the drum unit; and a material supply conduit having a connector that connects to the drum unit, and carries material including fiber into the drum unit by air flow; the internal sectional area of the connector being greater than the internal sectional area of the material supply conduit on the upstream side of the connector.

Thus comprised, the sheet manufacturing apparatus can reduce the velocity of the air flow in the connector to less than the velocity of the air flow upstream from the connector. As a result, the sheet manufacturing apparatus can produce sheets of uniform grammage while suppressing accumulation of material inside the material supply conduit.

A sheet manufacturing apparatus according to another aspect of the invention has: a rotatable, foraminous drum unit; a web forming unit configured to form a web using material including fiber that has passed through the holes in the drum unit; an air flow generator that produces an air flow to carry material including fiber; and a material supply conduit configured to carry material including fiber into the drum unit by the air flow produced by the air flow generator; the material supply conduit having a first part with an inside of a first sectional area, and a second part with an inside of a second sectional area that is larger than the first sectional area, and the second part is disposed closer to the drum unit than the air flow generator.

A sheet manufacturing apparatus according to this aspect of the invention can reduce the velocity of the air flow in the second part to less than the velocity of the air flow in the first part. As a result, the sheet manufacturing apparatus can produce sheets of uniform grammage while suppressing accumulation of material inside the material supply conduit.

In a sheet manufacturing apparatus according to the invention, the conveyance length of the second part is three times or greater than the internal width of the second part.

The sheet manufacturing apparatus thus comprised can further reduce the force pushing material including fiber horizontally inside the drum unit.

A sheet manufacturing apparatus according to another aspect of the invention includes: a rotatable, foraminous drum unit; a web forming unit configured to form a web using material including fiber that has passed through the holes in the drum unit; and a material supply conduit configured to carry material including fiber into the drum unit by air flow; the material supply conduit having a first supply conduit, a second supply conduit branching from the first supply conduit at a junction, and connecting to the drum unit at one end of the axis of rotation, and a third supply conduit branching from the first supply conduit at the junction, and connecting to the drum unit at the other end of the axis of rotation; the second supply conduit and third supply conduit having, at the end closer to the drum unit than the junction, a part where the internal sectional area is greater than the sectional area of the interface between the first supply conduit and the junction.

A sheet manufacturing apparatus thus comprised can reduce the velocity of the air flow in the large sectional area part inside the second supply conduit and third supply conduit. As a result, the sheet manufacturing apparatus can produce sheets of uniform grammage while suppressing accumulation of material inside the material supply conduit.

In a sheet manufacturing apparatus according to another aspect of the invention, the conveyance length of the larger sectional area part is three times or greater than the width of the larger part.

The sheet manufacturing apparatus thus comprised can further reduce the force pushing material including fiber horizontally inside the drum unit.

A sheet manufacturing method according to another aspect of the invention includes: a step of supplying material including fiber by air flow into a rotatable, foraminous drum unit; and a step of forming a web using material including fiber that has passed through the holes in the drum unit; the step of supplying material including fiber into the drum unit supplying the material into the drum unit by an air flow of a second velocity that is slower than the first velocity after conveying the material by an air flow of a first velocity.

A sheet manufacturing method thus comprised can manufacture sheets with uniform grammage while suppressing material being left inside the material supply conduit.

DESCRIPTION OF EMBODIMENTS

Preferred embodiments of the invention are described below with reference to the accompanying figures. Note that the embodiments described below do not unduly limit the scope of the invention described in the accompanying claims. All configurations described below are also not necessarily essential elements of the invention.

1. Embodiment 1

1.1. Configuration

Figure 1:
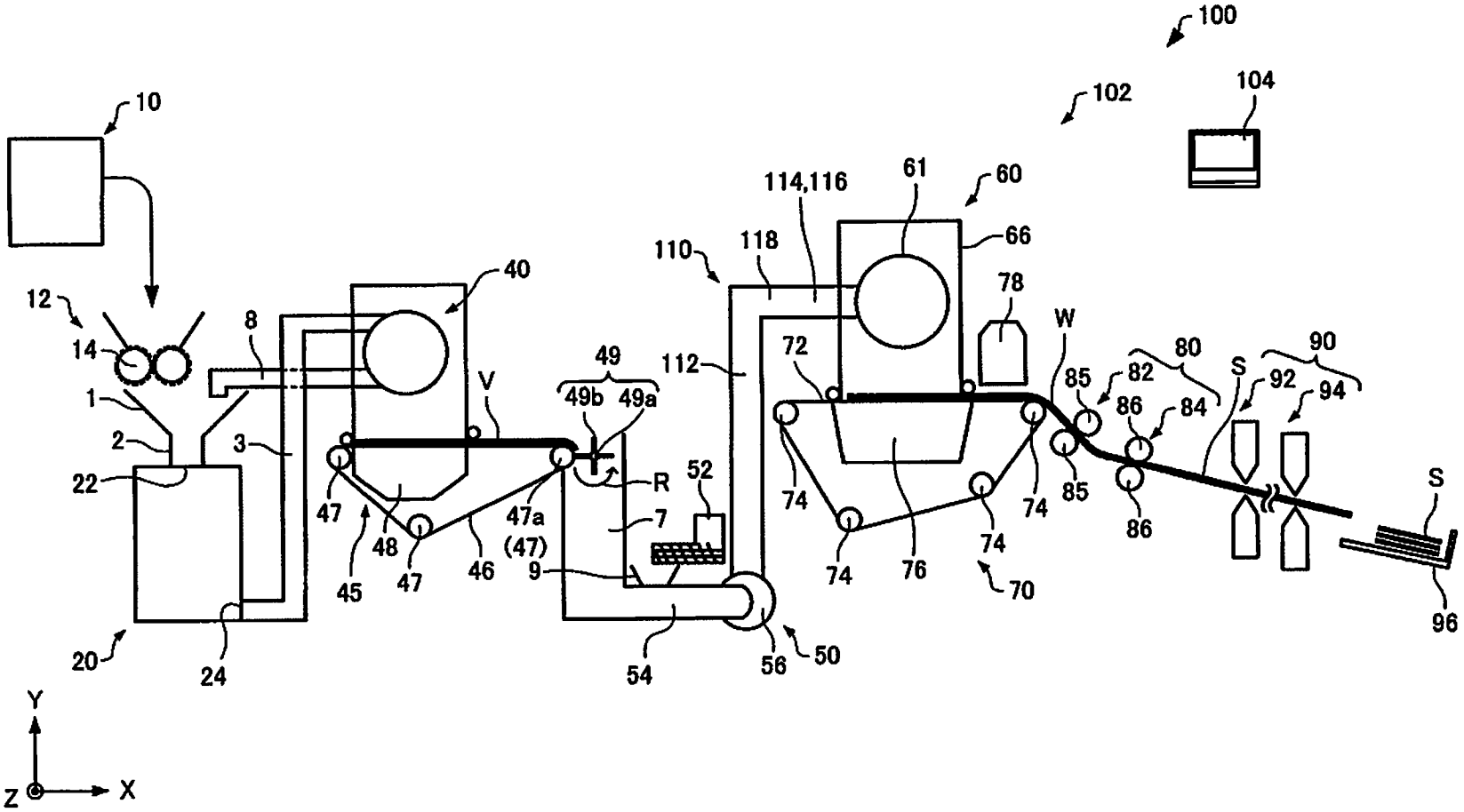
FIG. 1 schematically illustrates a sheet manufacturing apparatus according to an embodiment of the invention.

A sheet manufacturing apparatus according to a preferred embodiment is described below with reference to the accompanying figures. FIG. 1 schematically illustrates a sheet manufacturing apparatus 100 according to this embodiment.

As shown in FIG. 1, the sheet manufacturing apparatus 100 has a supply unit 10, manufacturing unit 102, and controller 104. The manufacturing unit 102 manufactures sheets. The manufacturing unit 102 includes a shredder 12, defibrating unit 20, separator 40, first web forming unit 45, rotor 49, mixing unit 50, air-laying unit 60, second web forming unit 70, sheet forming unit 80, and cutting unit 90.

The supply unit 10 supplies feedstock to the shredder 12. The supply unit 10 is, for example, an automatic loader for continuously supplying feedstock material to the shredder 12. The feedstock supplied by the supply unit 10 includes fiber from recovered paper or pulp sheets, for example.

The shredder 12 cuts feedstock supplied by the supply unit 10 into shreds in air. The shreds in this example are pieces a few centimeters in size. In the example in the figure, the shredder 12 has shredder blades 14, and shreds the supplied feedstock by the shredder blades 14. In this example, a paper shredder is used as the shredder 12. The feedstock shredded by the shredder 12 is received into a hopper 1 and carried (conveyed) to the defibrating unit 20 through a conduit 2.

The defibrating unit 20 defibrates the feedstock shredded by the shredder 12. Defibrate as used here is a process of separating feedstock (material to be defibrated) comprising interlocked fibers into individual detangled fibers. The defibrating unit 20 also functions to separate particulate such as resin, ink, toner, and sizing agents in the feedstock from the fibers.

Material that has passed through the defibrating unit 20 is referred to as defibrated material. In addition to untangled fibers, the defibrated material may also contain resin particles (resin used to bind multiple fibers together), coloring agents such as ink and toner, sizing agents, paper strengthening agents, and other additives that are separated from the fibers when the fibers are detangled. The shape of the detangled defibrated material is a string or ribbon. The detangled, defibrated material may be separated from (not interlocked with) other detangled fibers, or may be in lumps interlocked with other detangled defibrated material (in so-called fiber clumps).

The defibrating unit 20 defibrates in a dry process in ambient air (air). More specifically, an impeller mill is used as the defibrating unit 20. The defibrating unit 20 can also create an air flow that sucks in the feedstock and then discharges the defibrated material. As a result, the defibrating unit 20 can suction the feedstock with the air flow from the inlet 22, defibrate, and then convey the defibrated material to the exit 24 using the air flow produced by the defibrating unit 20. The defibrated material that has passed through the defibrating unit 20 is conveyed through a conduit 3 to the separator 40. Note that the air stream conveying the defibrated material from the defibrating unit 20 to the separator 40 may be the air flow created by the defibrating unit 20, or a separate blower or other fan unit may be used to create the air flow.

The separator 40 selects fibers by length from the defibrated material defibrated by the defibrating unit 20 that was introduced. A sieve (sifter) is used as the separator 40. The separator 40 has mesh (filter, screen), and can separate fiber or particles that are smaller than the size of the openings in the mesh (that pass through the mesh, first selected material) from fiber, undefibrated shreds, and clumps that are larger than the openings in the mesh (that do not pass through the mesh, second selected material). For example, the first selected material is conveyed through a conduit 7 to the mixing unit 50. The second selected material is returned through another conduit 8 to the defibrating unit 20. More specifically, the separator 40 is a cylindrical sieve that can be rotated by a motor. The mesh of the separator 40 may be a metal screen, expanded metal made by expanding a metal sheet with slits formed therein, or punched metal having holes formed by a press in a metal sheet.

The first web forming unit 45 conveys the first selected material from the separator 40 to the mixing unit 50. The first web forming unit 45 includes, for example, a mesh belt 46, tension rollers 47, and a suction unit (suction mechanism) 48.

The suction unit 48 suctions the first selected material that has passed through the openings (mesh openings) in the separator 40 and was dispersed in air onto the mesh belt 46. The first selected material accumulates on the moving mesh belt 46, forming a web V. The basic configuration of the mesh belt 46, tension rollers 47, and suction unit 48 are the same as the mesh belt 72, tension rollers 74, and suction mechanism 76 of the second web forming unit 70 described below.

The web V is a soft, fluffy web containing a lot of air as a result of passing through the separator 40 and first web forming unit 45. The web V formed on the mesh belt 46 is fed into a conduit 7 and conveyed to the mixing unit 50.

The rotor 49 cuts the web V before the web V is conveyed to the mixing unit 50. In the example in the figure, the rotor 49 has a base 49*a*, and blades 49*b* protruding from the base 49*a*. The blades 49*b* in this example have a flat shape. In the example in the figure, there are four blades 49*b*, and the four blades 49*b* are equally spaced around the base 49*a*. By the base 49*a* turning in direction R, the blades 49*b* rotate on the axis of the base 49*a*. By cutting the web V with the rotor 49, variation in the amount of defibrated material per unit time supplied to the air-laying unit 60, for example, can be reduced.

The rotor 49 is disposed near the first web forming unit 45. In the example in the figure, the rotor 49 is disposed near a tension roller 47*a* (beside the tension roller 47*a*) located at the downstream side of the conveyance path of the web V. The rotor 49 is disposed at a position where the blades 49*b* can contact the web V but do not touch the mesh belt 46 on which the web V is laid. As a result, wear (damage) to the mesh belt 46 by the blades 49*b* can be suppressed. The minimum distance between the blades 49*b* and mesh belt 46 is preferably greater than or equal to 0.05 mm and less than or equal to 0.5 mm. for example.

The mixing unit 50 mixes an additive containing resin with the first selected material (the first selected material conveyed by the first web forming unit 45) that has passed through the separator 40. The mixing unit 50 has an additive supply unit 52 that supplies additive, a conduit 54 for conveying the selected material and additive, and a blower 56. In the example in the figure, the additive is supplied from the additive supply unit 52 through a hopper 9 to a conduit 54. Conduit 54 communicates with conduit 7.

The mixing unit 50 uses the blower 56 to produce an air flow, and can convey while mixing the selected material and additives in the conduit 54. Note that the mechanism for mixing the first selected material and additive is not specifically limited, and may mix by means of blades turning at high speed, or may use rotation of the container like a V blender.

A screw feeder such as shown in FIG. 1, or a disc feeder not shown, for example, may be used as the additive supply unit 52. The additive supplied from the additive supply unit 52 contains resin for binding multiple fibers together. The multiple fibers are not bound when the resin is supplied. The resin melts and binds multiple fibers when passing through the sheet forming unit 80.

The resin supplied from the additive supply unit 52 is a thermoplastic resin or thermoset resin, such as AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone. These resins may be used individually or in a desirable combination. The additive supplied from the additive supply unit 52 may be fibrous or powder.

Depending on the type of sheet being manufactured, the additive supplied from the additive supply unit 52 may also include a coloring agent for coloring the fiber, an anti-blocking suppressant agent to prevent fiber agglomeration, or a flame retardant for making the fiber difficult to burn, in addition to resin for binding fibers. The mixture (a mixture of first selected material and additive) that has passed through the mixing unit 50 is conveyed through a material supply conduit 110 to the air-laying unit 60.

The mixture that has passed through the mixing unit 50 is introduced to the air-laying unit 60, which detangles and disperses the tangled defibrated material (fiber) in air while the mixture precipitates. When the resin in the additive supplied from the additive supply unit 52 is fibrous, the air-laying unit 60 also detangles interlocked resin fibers. As a result, the air-laying unit 60 can lay the mixture uniformly in the second web forming unit 70.

A cylindrical sieve that turns is used as the air-laying unit 60. The air-laying unit 60 has mesh, and causes fiber and particles smaller than the size of the mesh (that pass through the mesh) and contained in the mixture that has passed through the mixing unit 50 to precipitate. The configuration of the air-laying unit 60 is the same as the configuration of the separator 40 in this example.

Note that the sieve of the air-laying unit 60 may be configured without functionality for selecting specific material. More specifically, the "sieve" used as the air-laying unit 60 means a device having mesh, and the air-laying unit 60 may cause all of the mixture introduced to the air-laying unit 60 to precipitate.

The second web forming unit 70 lays the precipitate that has passed through the air-laying unit 60 into a web W. The web forming unit 70 includes, for example, a mesh belt 72, tension rollers 74, and a suction mechanism 76.

The mesh belt 72 is moving while precipitate that has passed through the holes (mesh) of the air-laying unit 60 accumulates thereon. The mesh belt 72 is tensioned by the tension rollers 74, and is configured so that air passes through but it is difficult for the precipitate to pass through. The mesh belt 72 moves when the tension rollers 74 turn. A web W is formed on the mesh belt 72 as a result of the mixture that has passed through the air-laying unit 60 precipitating continuously while the mesh belt 72 moves continuously. The mesh belt 72 may be metal, plastic, cloth, or nonwoven cloth.

The suction mechanism 76 is disposed below the mesh belt 72 (on the opposite side as the air-laying unit 60). The suction mechanism 76 produces a downward flow of air (air flow directed from the air-laying unit 60 to the mesh belt 72). The mixture distributed in air by the air-laying unit 60 can be pulled onto the mesh belt 72 by the suction mechanism 76. As a result, the discharge rate from the air-laying unit 60 can be increased. A downward air flow can also be created in the descent path of the mixture, and interlocking of defibrated material and additive during descent can be prevented, by the suction mechanism 76.

A soft, fluffy web w containing much air is formed by material passing through the air-laying unit 60 and second web forming unit 70 (web forming process) as described above. The web W laid on the mesh belt 72 is then conveyed to the sheet forming unit 80.

Note that a moisture content adjustment unit 78 for adjusting the moisture content of the web W is disposed in the example shown in the figure. The moisture content adjustment unit 78 adds water or water vapor to the web W to adjust the ratio of water to the web W.

The sheet forming unit 80 applies heat and pressure to the web W laid on the mesh belt 72, forming a sheet S. By applying heat to the mixture of defibrated material and additive contained in the web W, the sheet forming unit 80 can bind fibers in the mixture together through the additive (resin).

The sheet forming unit 80 includes a compression unit 82 that compresses the web W, and a heating unit 84 that heats the web W after being compressed by the compression unit 82. The compression unit 82 in this example comprises a pair of calender rolls 85 that apply pressure to the web W. Calendering reduces the thickness of the web W and increases the density of the web W. A heat roller (heating roller), hot press molding machine, hot plate, hot air blower, infrared heater, or flash fuser, for example, may be used as the heating unit 84. In the example in the figure, the heating unit 84 comprises a pair of heat rollers 86. By configuring the heating unit 84 with heat rollers 86, a sheet S can be formed while continuously conveying the web W, unlike when the heating unit 84 is configured with a flat press (flat press machine). The calender rolls 85 (compression unit 82) can apply greater pressure to the web W than the pressure that can be applied by the heat rollers 86 (heating unit 84). Note that the number of calender rolls 85 and heat rollers 86 is not specifically limited.

The cutting unit 90 cuts the sheet S formed by the sheet forming unit 80. In the example in the figure, the cutting unit 90 has a first cutter 92 that cuts the sheet S crosswise to the conveyance direction of the sheet S, and a second cutter 94 that cuts the sheet S parallel to the conveyance direction. In this example, the second cutter 94 cuts the sheet S after passing through the first cutter 92.

Cut sheets S of a specific size are formed by the process described above. The cut sheets S are then discharged to the discharge unit 96.

1.2. Air-Laying Unit and Material Supply Conduit

Figure 2:
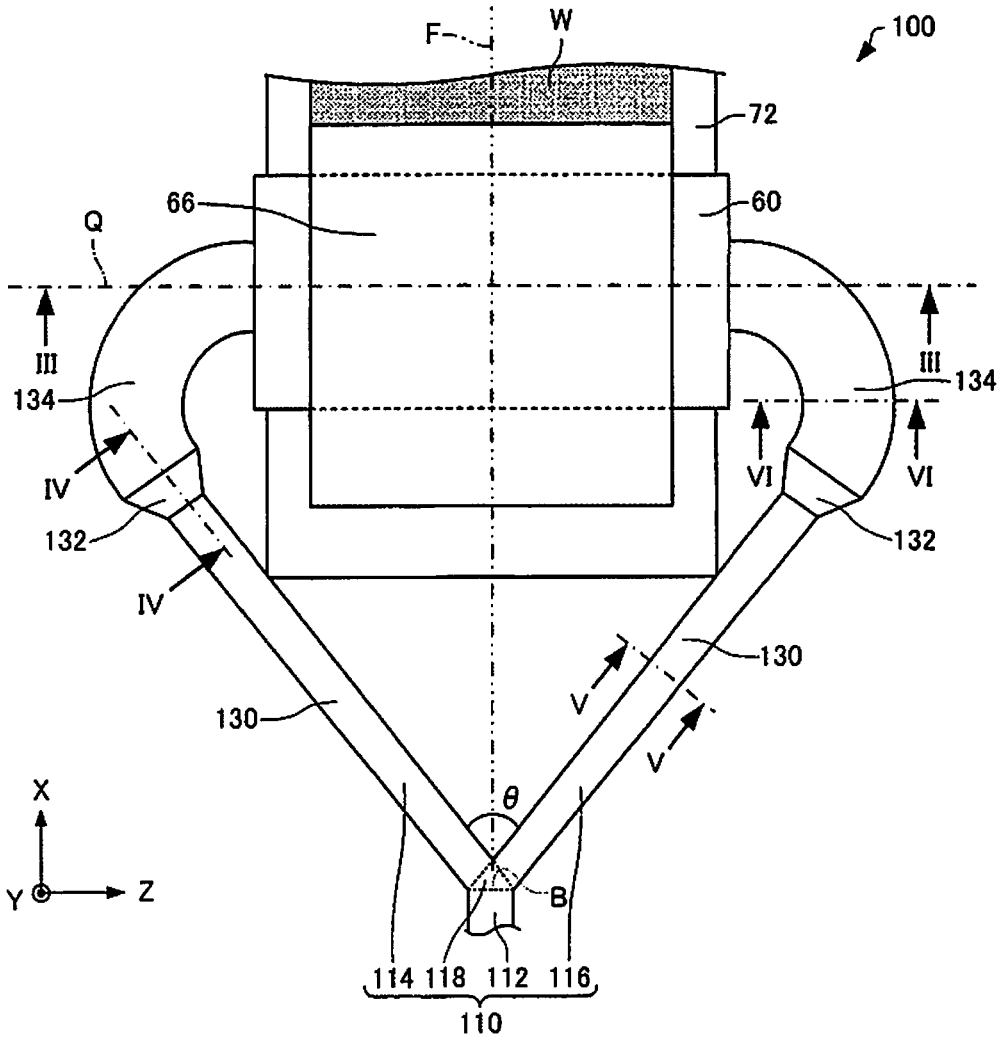
FIG. 2 is a plan view schematically illustrating a sheet manufacturing apparatus according to an embodiment of the invention.
Figure 3:
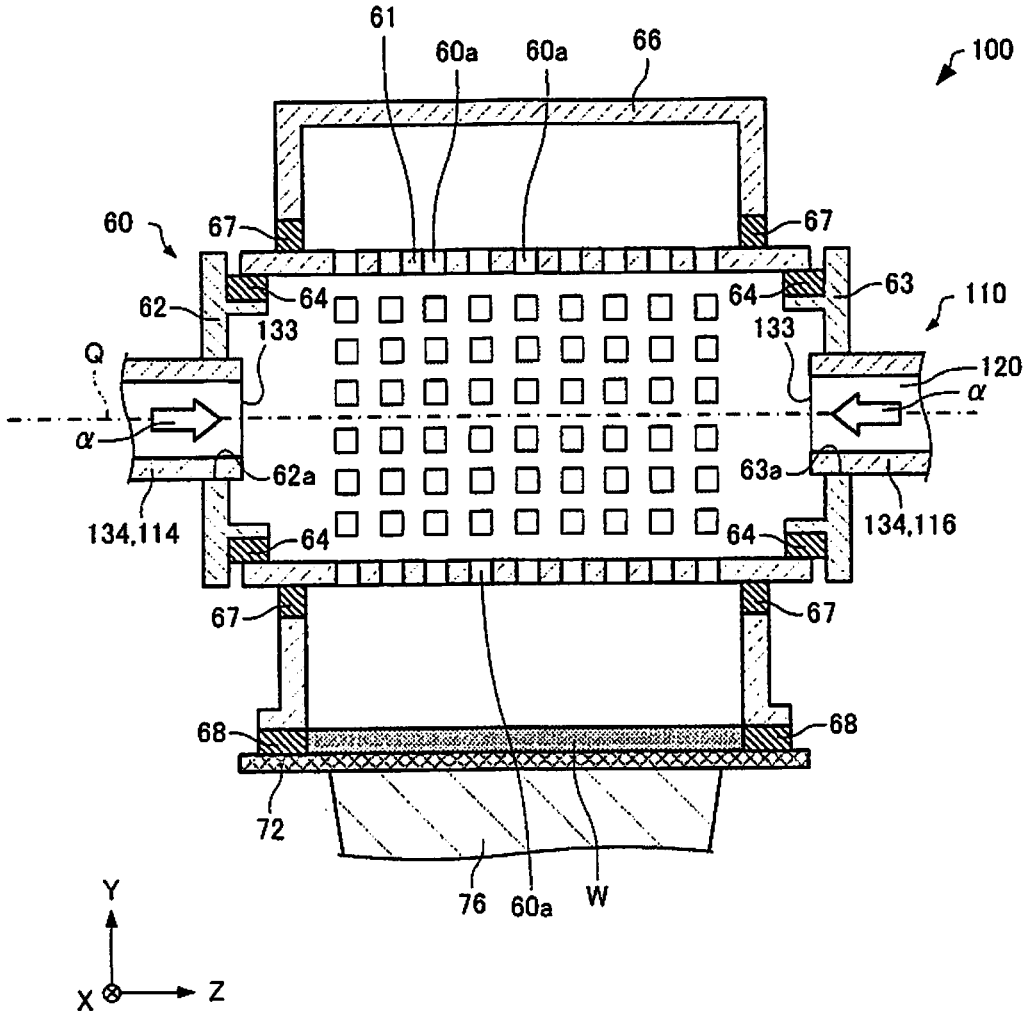
FIG. 3 is a section view schematically illustrating a sheet manufacturing apparatus according to an embodiment of the invention.
Figure 4:
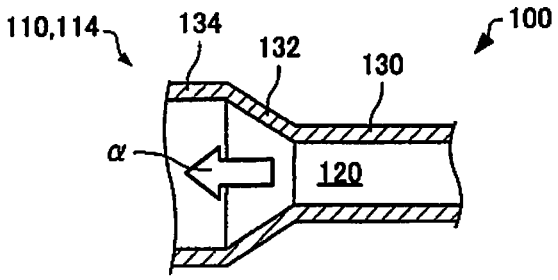
FIG. 4 is a section view schematically illustrating a sheet manufacturing apparatus according to an embodiment of the invention.
Figure 5:
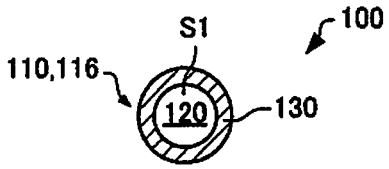
FIG. 5 is a section view schematically illustrating a sheet manufacturing apparatus according to an embodiment of the invention.
Figure 6:
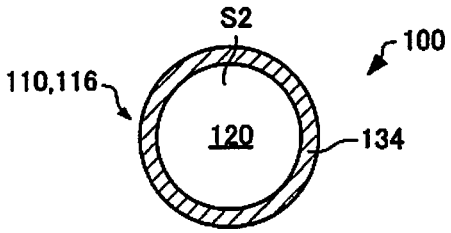
FIG. 6 is a section view schematically illustrating a sheet manufacturing apparatus according to an embodiment of the invention.

As described above, the sheet manufacturing apparatus 100 has a material supply conduit 110 (FIG. 1). FIG. 2 is a plan view illustrating the area around the air-laying unit 60 (drum unit) and material supply conduit 110 of the sheet manufacturing apparatus 100. FIG. 3 is a section view through line III-III in FIG. 2 schematically illustrating the sheet manufacturing apparatus 100. FIG. 4 is a section view through line IV-IV in FIG. 2 schematically illustrating the sheet manufacturing apparatus 100. FIG. 5 is a section view through line V-V in FIG. 2 schematically illustrating the sheet manufacturing apparatus 100. FIG. 6 is a section view through line VI-VI in FIG. 2 schematically illustrating the sheet manufacturing apparatus 100. Note that FIG. 1 to FIG. 3, and FIG. 7 to FIG. 9, show the X-axis, Y-axis, and Z-axis as three mutually perpendicular axes, and the direction down on the Y-axis (−Y direction) being the direction in which gravity works. Note that for convenience, the configuration of the material supply conduit 110 is shown simplified in FIG. 1.

As shown in FIG. 3, the air-laying unit 60 (drum unit) includes a screen 61 in which numerous holes 60*a* are formed, and two fixed, mutually parallel side walls 62, 63 disposed with the screen 61 therebetween. The screen 61 can rotate on axis of rotation Q (a horizontal axis, parallel to the Z-axis in the example in the figure). The side walls 62, 63 are panels parallel to the XY plane, for example, and the material supply conduit 110 is connected to the side walls 62, 63. First side wall 62 is the end wall of the drum unit 60 on one end of the axis of rotation Q (the side on the −Z-axis in the example in the figure). Second side wall 63 is the end wall of the drum unit 60 on the other end of the axis of rotation Q (the side on the +Z-axis in the example in the figure). A pile seal 64 (seal member) is disposed to the side walls 62, 63 to close the gap to the screen 61. The pile seal 64 is disposed to contact the surface (inside circumference surface) on the inside of the ends of the screen 61 (portions where the holes 60*a* are not formed).

At least the part of the drum unit 60 where the holes 60*a* are formed is covered by the housing 66 with a gap therebetween. The drum unit 60 is supported rotatably with a gap to the housing 66. A pile seal 67 for closing the gap to the screen 61 is disposed to the housing 66. The pile seal 67 is disposed in contact with the outside surface (outside circumference surface) of the screen 61. The housing 66 is disposed above the mesh belt 72, and the gap between the housing 66 and mesh belt 72 is closed by a pile seal 68. The pile seals 64, 67, 68 comprise a brush of bristles densely implanted to the surface of a base member. The second web forming unit 70 forms a web W using material including fiber (fiber (defibrated material)) that has passed through the holes 60*a* in the drum unit 60.

As shown in FIG. 1, the material supply conduit 110 extends from the blower 56 (air flow generator) of the mixing unit 50 to the drum unit 60. The blower 56 produces an air flow α for conveying material containing fiber. The material supply conduit 110 supplies material containing fiber into the drum unit 60 (screen 61) by means of the air flow α (FIG. 3) produced by the blower 56. The material supply conduit 110 forms a supply path 120 for supplying material containing fiber to the drum unit 60 by means of the air flow α produced by the blower 56. The velocity of the air flow α produced by the blower 56 may be controlled by a signal from the controller 104. The supply path 120 is a space defined by the material supply conduit 110, and is the space (hollow) inside the material supply conduit 110. The material supply conduit 110, as shown in FIG. 2, includes a first supply conduit 112, second supply conduit 114, third supply conduit 116, and junction 118.

The first supply conduit 112 connected to the blower 56 as shown in FIG. 1. In the example in FIG. 1, the first supply conduit 112 extends in the +Y-axis direction from the blower 56, and in the +X-axis direction to the junction 118. The sectional area (the sectional area of the plane perpendicular to the material supply direction) of the first supply conduit 112 is, for example, constant from the blower 56 to the junction 118.

As shown in FIG. 2, the first supply conduit 112 branches at the junction 118 in two to a second supply conduit 114 and a third supply conduit 116. More specifically, the first supply conduit 112 of the material supply conduit 110 splits at the junction 118 into a second supply conduit 114 and a third supply conduit 116. In the example in FIG. 2, the junction 118 is a triangle in plan view.

The second supply conduit 114 in this example branches from the first supply conduit 112 at the junction 118, and extends horizontally (on the XZ plane) from the junction 118. The second supply conduit 114 is connected to the first side wall 62 of the air-laying unit 60. In the example in FIG. 3, the second supply conduit 114 fits into an opening 62*a* in the first side wall 62. The inside of the second supply conduit 114 and the inside of the drum unit 60 are connected. The velocity (wind speed) of the air flow α inside the second supply conduit 114 is slower than the wind speed of the air flow α inside the first supply conduit 112. The velocity can be measured by a known anemometer.

The third supply conduit 116 branches, for example, from the first supply conduit 112 to the junction 118, and extends horizontally (in the XZ plane direction) from the junction 118. The third supply conduit 116 connects to the second side wall 63 of the drum unit 60. In the example in FIG. 3, the third supply conduit 116 fits into an opening 63*a* formed in the second side wall 63. The inside of the third supply conduit 116 communicates with the inside of the drum unit 60. The velocity (wind speed) of the air flow α in the third supply conduit 116 is lower than the velocity of the air flow α in the first supply conduit 112.

The second supply conduit 114 and third supply conduit 116 extend in different directions from the junction 118. The angle θ (FIG. 2) between the direction of the second supply conduit 114 and the direction of the third supply conduit 116 is, for example, greater than or equal to 90° and is less than or equal to 120°. If the angle θ is less than 90°, depending on the size of the air-laying unit 60 in the Z-axis direction, the length of the second supply conduit 114 and the third supply conduit 116 increase, and decreasing the size of the device may not be possible. If angle θ exceeds 120°, air flows from the blower 56 collide at the junction 118, and stably supplying material including fiber to the air-laying unit 60 may not be possible.

The path length of the second supply conduit 114 and the path length of the third supply conduit 116 are, for example, equal. Path length as used here is the length of the conduit in the material supply direction. The path length may be the axial length of the conduit. The path length of the second supply conduit 114 and the path length of the third supply conduit 116 being equal includes the difference between the path length of the second supply conduit 114 and the path length of the third supply conduit 116 being zero, and the difference between the path lengths being within a specific margin of manufacturing error (for example, within 3% of the path length. The second supply conduit 114 and third supply conduit 116 may also be symmetrical to an imaginary plane (an imaginary plane parallel to the XY plane in the example in the figure) through the junction 118 and perpendicular to the axis of rotation Q of the air-laying unit 60.

The second supply conduit 114 and third supply conduit 116 include a first part 130, a transition 132, and a second part 134. The inside of the first part 130 has a first sectional area S1. Sectional area as used here is the area in the direction crosswise to the supply direction of material in the supply conduit. The sectional area of the inside of the first part 130 may be the same as the sectional area of the inside of the first supply conduit 112. The first part 130 connects to the junction 118. In the example in the figure, the first part 130 is straight.

The transition 132 connects the first part 130 and the second part 134. The transition 132 is a part in which the internal sectional area gradually increases from the upstream side to the downstream side. Downstream as used here means the side to which the material including fiber flows (the direction to which the material including fiber travels to the discharge unit 96), and the upstream side is the opposite of the downstream side. More specifically, the internal sectional area of the transition 132 increases gradually from the first part 130 side to the second part 134 side. In the example in the figure, the transition 132 is straight.

The inside of the second part 134 has a second sectional area S2. This second sectional area S2 is greater than the first sectional area S1. The second part 134 is the part where the internal sectional area is greater than the sectional area of the interface B (FIG. 2) between the first supply conduit 112 and junction 118. The second supply conduit 114 and third supply conduit 116 have a second part 134 on the end closer to the drum unit 60 than the junction 118. The second part 134 is disposed to the side closer to the drum unit 60 than the blower 56. The second part 134 connects to the drum unit 60. The second part 134 is the part that connects to the drum unit 60. As shown in FIG. 3, the second part 134 has a supply port 133 for supplying material including fiber into the drum unit 60. The width (such as the diameter) of the supply port 133 is less than the width (such as diameter) of the inside of the drum unit 60. The second part 134 communicates with the inside of the drum unit 60 through the supply port 133. The sectional area of the supply port 133 is, for example, second sectional area S2.

The second part 134 (connection) has a bend. In the example in the figure, the entire second part 134 is the bend. In other words, the second part 134 is a bend. A bend has a curved shape. The second part 134 may comprise a single conduit with a bend, or multiple straight conduits welded together to form a bend. The second part (bend) 134 curves from the horizontal and connects to the drum unit 60.

Note that while not shown in the figures, the second part 134 (bend) may bend down from the axis of rotation Q of the drum unit 60 and connect to the drum unit 60. In other words, the supply conduits 114, 116 may extend from the junction 118 in the +Y-axis direction, curve at the second part 134 (bend), and connect to the drum unit 60.

The length of the second part 134 is, for example, three times or greater than the width of the inside of the second part 134. Here, the inside width is the diameter when the inside is round in section (that is, when the sectional shape of the second part 134 is round), and when the sectional shape of the inside is polygonal, is the length of the longest axis between corners of the polygon.

The sectional area of the inside of the second part 134 (connector) is greater than the sectional area of the inside of the material supply conduit 110 on the upstream side of the second part 134. More specifically, the internal sectional area of the second part 134 is greater than the internal sectional area of the first supply conduit 112, the internal sectional area of the first part 130, and the internal sectional area of the transition 132. Note that because the second part 134 and transition 132 are connected, the sectional area thereof at the boundary is the same. The velocity of the air flow α (the air flow α inside the second part 134) in the second part 134 (connection) is less than the velocity of the air flow α (the air flow α inside the material supply conduit 110 on the upstream side) upstream from the second part 134. More specifically, the velocity of air flow α in the second part 134 is less than the velocity of air flow α in the first supply conduit 112, the velocity of air flow α in the first part 130, and the velocity of air flow α in the transition 132. Upstream from the second part 134 means, for example, the part of the material supply conduit 110 between the second part 134 and the blower 56 (the part to the blower 56).

For example, if the sectional shape of the material supply conduit 110 is round, the inside diameter of the first supply conduit 112 and first part 130 is 40 mm, the inside diameter of the second part 134 is 100 mm, and the total flow through the material supply conduit 110 is 1.2 $m^3$/min, the velocity (wind speed) inside the first supply conduit 112 is 16 m/s, 8 m/s inside the first part 130, and 1.3 m/s inside the second part 134. As a result, the sheet manufacturing apparatus 100 can supply material including fiber into the drum unit 60 by conveying the material by air flow α of a first velocity in the first part 130, and then conveying the material in second part 134 by an air flow α of a second velocity that is lower than the first velocity.

Features of the sheet manufacturing apparatus 100 are described below.

In this sheet manufacturing apparatus 100, the velocity of air flow α in the connector 134 is less than the velocity of the air flow α upstream from the connector 134. As a result, compared with a configuration in which the air flow α velocity in the connector 134 is greater than the air flow α velocity upstream from the connector 134, the sheet manufacturing apparatus 100 can reduce the force pushing the material including fiber horizontally inside the drum unit 60 (in the Z-axis direction in the figure). As a result, the uniformity of the thickness of the web W in the Z-axis direction can be improved, and the uniformity of the grammage of the manufactured sheet S can therefore be improved. In addition, compared with a configuration in which the velocity of the air flow α upstream from the connector 134 is the same as the velocity of the air flow α at the connector 134, the sheet manufacturing apparatus 100 can suppress residue of the material including fiber being left inside the material supply conduit 110 upstream from the connector 134. Therefore, the sheet manufacturing apparatus 100 can manufacture a sheet S with uniform grammage while suppressing residue of material left inside the material supply conduit 110.

Note that the air flow produced by the suction mechanism 76 may increase the vertical velocity, relatively decreasing the velocity of the horizontal air flow, but because the exhaust flow from the suction mechanism 76 increases, decreasing the equipment size may not be possible. Furthermore, because the exhaust flow from the second air flow generator 76 increases, where the system can be installed may be limited.

In the sheet manufacturing apparatus 100, the first supply conduit 112 of the material supply conduit 110 splits into a second supply conduit 114 and third supply conduit 116 at the junction 118, and the second supply conduit 114 and third supply conduit 116 connect to the drum unit 60. As a result, material including fiber can be supplied in the sheet manufacturing apparatus 100 from both sides of the drum unit 60, and the uniformity of the thickness of the web W in the Z-axis direction can be improved.

In the sheet manufacturing apparatus 100, the second supply conduit 114 and third supply conduit 116 are formed symmetrically to an imaginary plane F through the junction 118 and perpendicular to the axis of rotation Q of the drum unit 60. As a result, in the sheet manufacturing apparatus 100, the difference in the amount of material per unit time supplied to the inside of the drum unit 60 from the second supply conduit 114, and the amount of material per unit time supplied to the inside of the drum unit 60 from the third supply conduit 116, can be reduced. As a result, the sheet manufacturing apparatus 100 can further improve the uniformity of the thickness of the web W in the Z-axis direction.

In the sheet manufacturing apparatus 100, the sectional area of the inside of the connector 134 is greater than the sectional area of the inside of the material supply conduit 110 upstream from the connector 134. As a result, in the sheet manufacturing apparatus 100, the air flow α velocity in the connector 134 can be made less than the air flow α velocity upstream from the connector 134.

In the sheet manufacturing apparatus 100, the material supply conduit 110 has a transition 132 of which the internal sectional area increases gradually from the upstream side to the downstream side. As a result, the sheet manufacturing apparatus 100 can reduce eddy currents and other disruption of the air flow α in the transition 132.

The connector 134 of the sheet manufacturing apparatus 100 has a bend. As a result, there is greater freedom in the sheet manufacturing apparatus 100 in the designing the shape of the material supply conduit 110, for example, and the path length of the material supply conduit 110 connecting the mixing unit 50 and drum unit 60 can be shortened.

In the sheet manufacturing apparatus 100, the length of the second part 134 is three or more times the internal width of the second part 134. As a result, in the sheet manufacturing apparatus 100, the force pushing material including fiber horizontally inside the drum unit 60 (on the Z-axis in the example in the figures) can be reduced. For example, if the length of the second part 134 is less than three times the internal width of the second part 134, the force pushing material horizontally inside the drum unit 60 cannot be sufficient reduced, and the uniformity of the thickness of the web W in the Z-axis direction may decrease.

The material supply conduit 110 of the sheet manufacturing apparatus 100 has a first part 130, the inside of which has a first sectional area S1, and a second part 134, the inside of which has a second sectional area S2 that is greater than the first sectional area S1, and the second part 134 is disposed closer to the drum unit 60 than the blower 56. As a result, the sheet manufacturing apparatus 100 can suppress material residue left inside the material supply conduit 110, and can manufacture a sheet S with uniform grammage.

In the sheet manufacturing apparatus 100, the second supply conduit 114 and third supply conduit 116 have, on the drum unit 60 side of the junction 118, a part 134 with an internal sectional area that is greater than the sectional area of the interface between the first supply conduit 112 and junction 118. As a result, the sheet manufacturing apparatus 100 can suppress material residue inside the material supply conduit 110 while manufacturing a sheet S with good uniformity of grammage.

A sheet manufacturing method according to the invention uses the sheet manufacturing apparatus 100 described above, for example. As described above, the sheet manufacturing method using the sheet manufacturing apparatus 100 includes a step of supplying material including fiber to the inside of a rotatable drum unit 60 in which numerous holes 60*a* are formed, and a step of forming a web W using material including fiber that has passed through the holes 60*a* in the drum unit 60. The step of supplying material including fiber to the inside of the drum unit 60 conveys material including fiber by an air flow α of a first velocity, and then conveys the material by an air flow α of a second velocity that is slower than the first velocity. As a result, the sheet manufacturing method of the invention can suppress the amount of material residue left inside the material supply conduit 110 while manufacturing sheets S with uniform grammage.

Note that in the sheet manufacturing apparatus according to the invention, defibrated material that has passed through the defibrating unit 20 may be conveyed through the conduit 3 to a classifier (not shown in the figure). The classified material separated by the classifier may be conveyed to the separator 40. The classifier classifies defibrated material that has passed through the defibrating unit 20. More specifically, the classifier separates and removes relatively small or low density material (such as resin particles, color agents, additives) from the defibrated material. As a result, the percentage of relatively large or high density fiber in the defibrated material can be increased. The classifier may be, for example, a cyclone, elbow joint, or eddy classifier.

2. Sheet Manufacturing Apparatus Variations

2.1. First Variation

Figure 7:
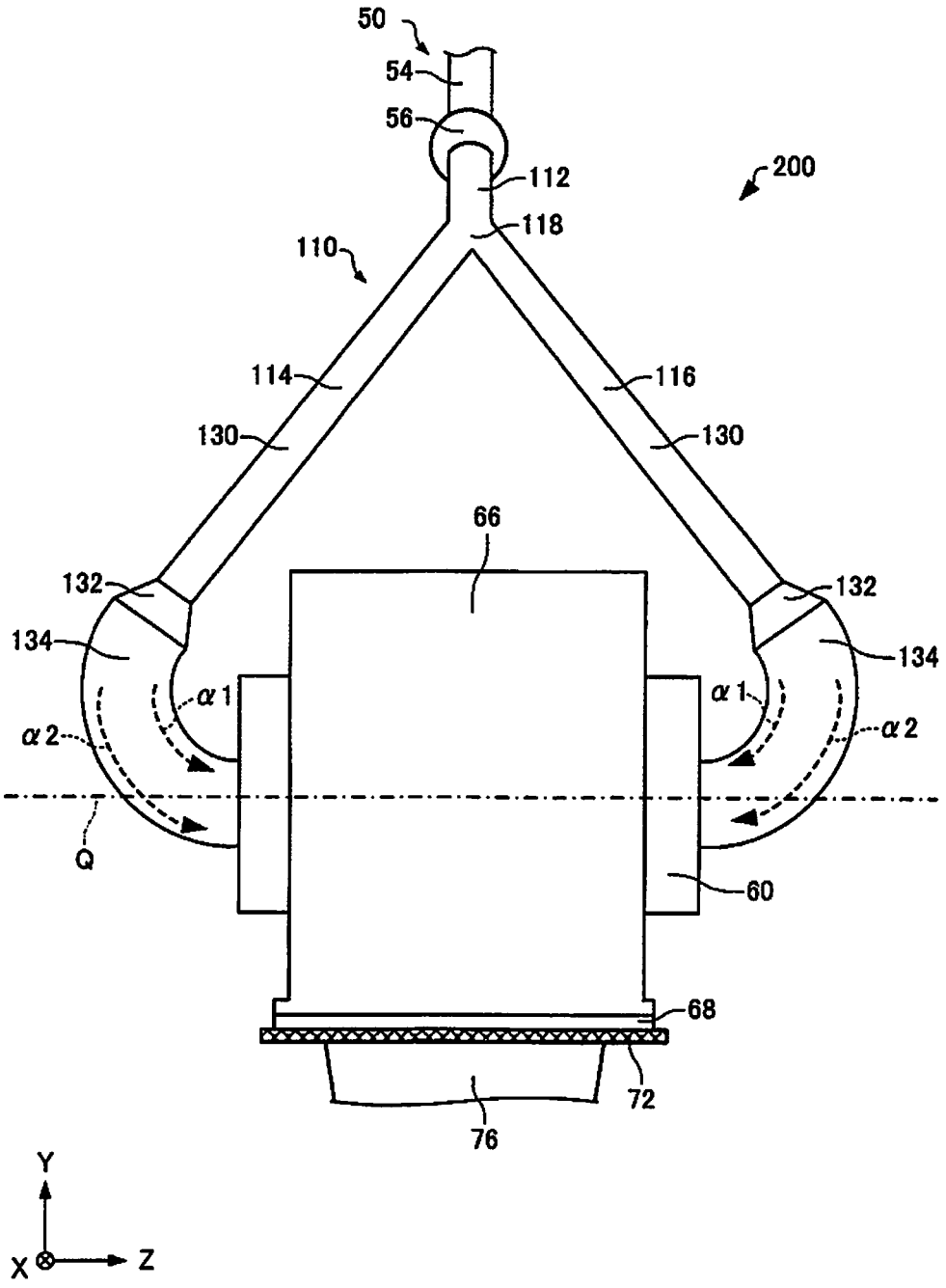
FIG. 7 schematically illustrates a sheet manufacturing apparatus according to the invention.

A sheet manufacturing apparatus according to a first variation of embodiment described above is described next with reference to the accompanying figures. FIG. 7 schematically illustrates a sheet manufacturing apparatus 200 according to a first variation of the foregoing embodiment. FIG. 7 illustrates the area around the drum unit 60 and material supply conduit 110 of the sheet manufacturing apparatus 200.

Below, like parts in the sheet manufacturing apparatus 200 according to this first variation and the sheet manufacturing apparatus 100 described above are identified by like reference numerals, and further detailed description thereof is omitted. This also applies to the second variation of the sheet manufacturing apparatus described below.

As shown in FIG. 2, in the sheet manufacturing apparatus 100 described above, the second part 134 (bend) bends horizontally and connects to the drum unit 60.

In the sheet manufacturing apparatus 200 shown in FIG. 7, however, the second part 134 (bend) connects to the drum unit 60 from above (bends from above) a horizontal plane (virtual plane parallel to the XZ plane) through the axis of rotation Q of the drum unit 60. In the example in the figure, the mixing unit 50 and junction 118 that mix the fiber and additive in air are located above (the +Y-axis side) the axis of rotation Q of the drum unit 60. In this sheet manufacturing apparatus 200, the material supply conduit 110 extends down (to the −Y-axis side) from the mixing unit 50, bends at the second part 134, and connects to the drum unit 60.

The velocity of the portion α1 on the inside-side of the air flow α (the inside-side of the inside of the second part 134, the side with the greater curvature) may be slower than the portion α2 along the outside side of the air flow α (the outside-side of the inside of the second part 134, the side with the less curvature). In the sheet manufacturing apparatus 200, the second part 134 connects to the drum unit 60 above the axis of rotation Q. As a result, even if the velocity of the portion α1 on the inside-side of the second part 134 is less than the portion α2 along the outside side, material conveyed by the portion α1 passing through the inside moves by gravity to the outside of the inside of the second part 134, and can be conveyed into the drum unit 60 by the portion α2 passing on the outside of the air flow α. Therefore, the likelihood of material being left to accumulate inside because the velocity of the air flow on the inside side of the second part 134 is low can be reduced.

In the sheet manufacturing apparatus 200, the mixing unit 50 and junction 118 are located above (on the +Y-axis side) the axis of rotation Q of the drum unit 60. As a result, the length of the material supply conduit 110 connecting the mixing unit 50 and the drum unit 60 can be shortened. Furthermore, because gravity can be used to convey the material, material being left inside the material supply conduit 110 can be suppressed, and a sheet S with good uniformity of grammage can be manufactured.

2.2. Second Variation

Figure 8:
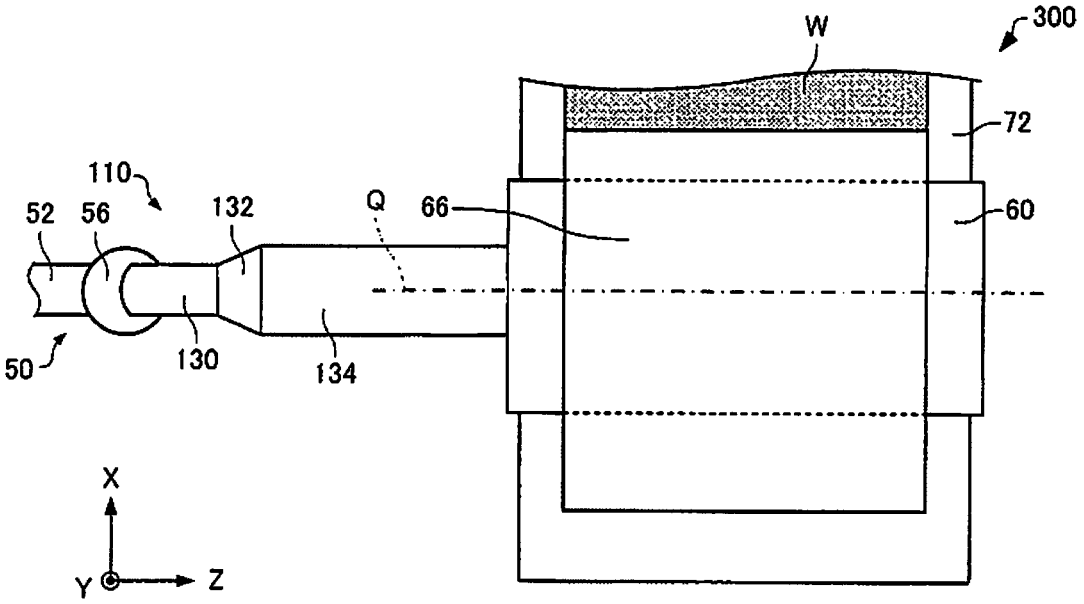
FIG. 8 is a plan view schematically illustrating a sheet manufacturing apparatus according to an embodiment of the invention.
Figure 9:
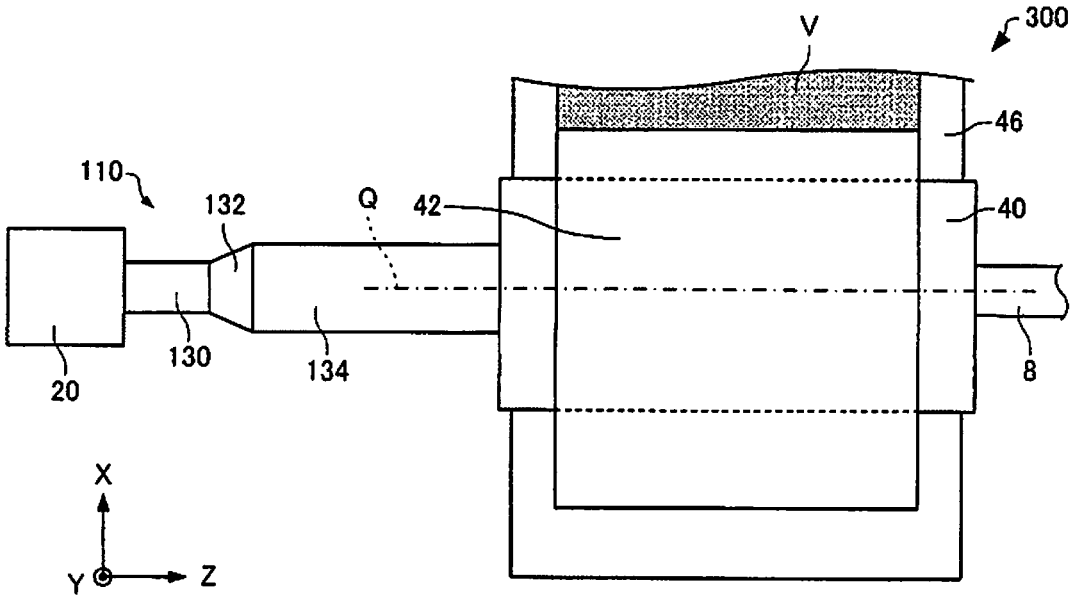
FIG. 9 is a plan view schematically illustrating a sheet manufacturing apparatus according to an embodiment of the invention.

A sheet manufacturing apparatus according to a second variation of the foregoing embodiment is described below. FIG. 8 is a plan view schematically illustrating a sheet manufacturing apparatus 300 according to this second variation of the invention. FIG. 8 shows the area around the drum unit 60 and material supply conduit 110 of the sheet manufacturing apparatus 300.

As shown in FIG. 2, the first supply conduit 112 of the material supply conduit 110 of the sheet manufacturing apparatus 100 described above splits at the junction 118 into a second supply conduit 114 and third supply conduit 116.

As shown in FIG. 8, however, the material supply conduit 110 of the sheet manufacturing apparatus 300 in this example does not have a junction 118 and does not branch. In the example in the figure, the material supply conduit 110 extends straight from the mixing unit 50 and connects to the air-laying unit 60. The material supply conduit 110 connects to the drum unit 60 at only one side on the axis of rotation Q.

The foregoing examples describe configurations in which the material supply conduit 110 connects to the drum unit 60 as the air-laying unit, but the material supply conduit 110 may connect to the drum unit 40 used as a separator in a sheet manufacturing apparatus according to the invention. In other words, the conduit 3 (FIG. 1) may be the material supply conduit 110. More specifically, in the sheet manufacturing apparatus 300 shown in FIG. 9, because the material supply conduit 110 connects to the drum unit 40 at only one side on the axis of rotation Q, a conduit 8 may connect to the drum unit 40, separator, at the other side on the axis of rotation Q, and large fibers, undefibrated paper particles, and clumps (material that did not pass through the sieve, second screened material) can be returned through the 8 to the defibrating unit 20. In the example in FIG. 9, the material supply conduit 110 extends straight from the defibrating unit 20 and is connected to the drum unit 40. In this case, the upstream side from the second part 134 is the part of the material supply conduit 110 between the second part 134 and the blower 56 (the part to the blower 56), for example. Alternatively, if there is no blower 56 (air flow generator), the upstream side of the second part 134 is the part of the material supply conduit 110 between the second part 134 and the defibrating unit 20 (the part to the defibrating unit 20), for example. At least the part of the drum 40 in which holes are formed is covered by a housing 42 with a gap therebetween. The first web forming unit 45 forms a web V using material including fiber that has passed through the holes in the drum unit 40.

Note that a sheet S manufactured by the sheet manufacturing apparatus according to this embodiment refers primarily to a medium formed in a sheet. The invention is not limited to making sheets, however, and may produce board and web forms. Sheets as used herein include paper and nonwoven cloth. Paper includes products manufactured as thin sheets from pulp or recovered paper as the feedstock, and includes recording paper for handwriting or printing, wall paper, wrapping paper, construction paper, drawing paper, and bristol. Nonwoven cloth may be thicker than paper and low strength, and includes common nonwoven cloth, fiber board, tissue paper (tissue paper for cleaning), kitchen paper, vacuum filter bags, filters, fluid (waste ink, oil) absorbers, sound absorbers, cushioning materials, and mats. The feedstock may include cellulose and other plant fiber, PET (polyethylene terephthalate), polyester, and other types synthetic fiber, wool, silk, and other types of animal fiber.

The invention may be configured to omit some of the configurations described above insofar as the features and effects described above are retained, and may combine aspects of different embodiments and examples. Note that as long as it can manufacture sheets, the manufacturing unit 102 maybe modified by omitting some configurations, adding other configurations, and substituting configurations known from the related art.

The invention includes configurations (such as configurations having the same function, method, and result, or configurations having the same purpose and effect) having effectively the same configuration as those described above. The invention also includes configurations that replace parts that are not essential to the configuration described in the foregoing embodiment. Furthermore, the invention includes configurations having the same operating effect, or configurations that can achieve the same objective, as configurations described in the foregoing embodiment. Furthermore, the invention includes configurations that add technology known from the literature to configurations described in the foregoing embodiment.

REFERENCE SIGNS LIST

1 hopper
2, 3, 4, 5, 7, 8 conduit
9 hopper
10 supply unit
12 shredder
14 shredder blades
20 defibrating unit
22 inlet port
24 discharge port
40 separator
42 housing
45 first web forming unit
46 mesh belt

47, 47*a* tension rollers
48 suction unit
49 rotor
49*a* base
49*b* blades
50 mixing unit
52 additive supply unit
56 blower
60 air-laying unit
60*a* holes
61 screen
62 first side wall
62*a* opening
63 second side wall
63*a* opening
64 pile seal
66 housing
67, 68 pile seal
70 second web forming unit
72 mesh belt
74 tension rollers
76 suction mechanism
78 moisture content adjustment unit
80 sheet forming unit
82 calender
84 heat unit
85 calender rolls
86 heat rollers
90 cutting unit
92 first cutting unit
94 second cutting unit
96 discharge unit
100 sheet manufacturing apparatus
102 manufacturing unit
104 controller
110 material supply conduit
112 first supply conduit
114 second supply conduit
116 third supply conduit
118 junction
120 supply path
130 first part
132 transition
133 supply port
134 second part
200, 300 sheet manufacturing apparatus
B interface
F virtual plane
R direction
S sheet
S1 first sectional area
S2 second sectional area
V, W web
α air flow
α1 portion passing inside
α2 portion passing outside

The invention claimed is:

1. A sheet manufacturing apparatus comprising:
a rotatable, foraminous drum unit;
a web forming unit configured to form a web using material including fiber that has passed through the holes in the drum unit; and
a material supply conduit having a connector that connects to the drum unit, and carrying material including fiber into the drum unit by air flow;
the velocity of the air flow in the connector being lower than the velocity of the air flow on the upstream side of the connector.

2. The sheet manufacturing apparatus according to claim 1, wherein:
a first supply conduit of the material supply conduit splits at a junction into a second supply conduit and a third supply conduit;
the second supply conduit and third supply conduit both connect to the drum unit; and
the velocity of the air flow in the second supply conduit and third supply conduit is less than the velocity of the air flow in the first supply conduit.

3. The sheet manufacturing apparatus according to claim 2, wherein:
the second supply conduit connects to the drum unit at one end of the axis of rotation;
the third supply conduit connects to the drum unit at the other end of the axis of rotation;
and the second supply conduit and third supply conduit are symmetrical to a virtual plane through the junction and perpendicular to the axis of rotation of the drum unit.

4. The sheet manufacturing apparatus according to claim 2, wherein:
the junction is above the axis of rotation of the drum unit.

5. The sheet manufacturing apparatus according to claim 1, wherein:
the internal sectional area of the connector is greater than the internal sectional area of the material supply conduit on the upstream side of the connector.

6. The sheet manufacturing apparatus according to claim 5, wherein:
the material supply conduit has a transition wherein the internal sectional area increases gradually from the upstream side to the downstream side.

7. The sheet manufacturing apparatus according to claim 1, wherein:
the connector has a bend.

8. The sheet manufacturing apparatus according to claim 7, wherein:
the bend connects to the drum unit above the axis of rotation of the drum unit.

9. The sheet manufacturing apparatus according to claim 1, further comprising:
a mixer configured to mix fiber and additive in air;
the web forming unit laying a web using material including fiber and additive; and
the mixer being located above the axis of rotation of the drum unit.

10. A sheet manufacturing apparatus comprising:
a rotatable, foraminous drum unit including a screen that is rotatable around a rotation axis and a pair of side walls to which the screen is rotatable coupled, at least one of the side walls having an opening that penetrates completely through the at least one of the side walls in a direction along the rotation axis;
a web forming unit configured to form a web using material including fiber that has passed through the holes in the drum unit; and
a material supply conduit having a connector that connects to the at least one of the side walls such that material including fiber is carried through the opening into the drum unit by air flow;
the internal sectional area of the connector being greater than the internal sectional area of the material supply conduit on the upstream side of the connector.

11. A sheet manufacturing apparatus comprising:

a rotatable, foraminous drum unit including a screen that is rotatable around a rotation axis and a pair of side walls to which the screen is rotatable coupled, at least one of the side walls having an opening that penetrates completely through the at least one of the side walls in a direction along the rotation axis;

a web forming unit configured to form a web using material including fiber that has passed through the holes in the drum unit;

an air flow generator that produces an air flow to carry material including fiber; and a material supply conduit configured to carry material including fiber into the drum unit by the air flow produced by the air flow generator;

the material supply conduit having a first part with an inside of a first sectional area, and a second part with an inside of a second sectional area that is larger than the first sectional area, and the second part being disposed closer to the drum unit than the air flow generator and connecting to the at least one of the side walls such that the material including fiber is carried through the opening into the drum unit by the air flow.

12. The sheet manufacturing apparatus according to claim 11, wherein:

the conveyance length of the second part is three times or greater than the internal width of the second part.

13. A sheet manufacturing apparatus comprising:

a rotatable, foraminous drum unit;

a web forming unit configured to form a web using material including fiber that has passed through the holes in the drum unit; and a material supply conduit configured to carry material including fiber into the drum unit by air flow;

the material supply conduit having a first supply conduit, a second supply conduit branching from the first supply conduit at a junction, and connecting to the drum unit at one end of the axis of rotation, and a third supply conduit branching from the first supply conduit at the junction, and connecting to the drum unit at the other end of the axis of rotation;

the second supply conduit and third supply conduit having, at the end closer to the drum unit than the junction, a part where the internal sectional area is greater than the sectional area of the interface between the first supply conduit and the junction.

14. The sheet manufacturing apparatus according to claim 13, wherein:

the conveyance length of the larger sectional area part is three times or greater than the width of the larger part.

15. A sheet manufacturing method comprising:

a step of supplying material including fiber by air flow into a rotatable, foraminous drum unit; and a step of forming a web using material including fiber that has passed through the holes in the drum unit;

the step of supplying material including fiber into the drum unit supplying the material into the drum unit by an air flow of a second velocity that is slower than the first velocity after conveying the material by an air flow of a first velocity.

* * * * *